US008425278B2

(12) United States Patent
Culler et al.

(10) Patent No.: US 8,425,278 B2
(45) Date of Patent: Apr. 23, 2013

(54) STRUCTURED ABRASIVE ARTICLE AND METHOD OF USING THE SAME

(75) Inventors: Scott R Culler, Burnsville, MN (US); John D. Haas, Roseville, MN (US); Chaodi Li, Woodbury, MD (US)

(73) Assignee: 3M Innovative Properties Company, St. Paul, MN (US)

( * ) Notice: Subject to any disclaimer, the term of this patent is extended or adjusted under 35 U.S.C. 154(b) by 312 days.

(21) Appl. No.: 12/547,590

(22) Filed: Aug. 26, 2009

(65) Prior Publication Data

US 2011/0053460 A1 Mar. 3, 2011

(51) Int. Cl.
*B24B 1/00* (2006.01)

(52) U.S. Cl.
USPC ..... 451/56; 451/41; 451/529; 451/533

(58) Field of Classification Search ..... 451/56, 451/527, 528.529, 533, 539
See application file for complete search history.

(56) References Cited

U.S. PATENT DOCUMENTS

| | | | | |
|---|---|---|---|---|
| 4,652,274 | A | | 3/1987 | Boettcher et al. |
| 4,751,138 | A | | 6/1988 | Tumey et al. |
| 4,903,440 | A | | 2/1990 | Larson et al. |
| 4,985,340 | A | | 1/1991 | Palazzotto et al. |
| 5,086,086 | A | | 2/1992 | Brown-Wensley et al. |
| 5,152,917 | A | | 10/1992 | Pieper et al. |
| 5,236,472 | A | | 8/1993 | Kirk et al. |
| 5,254,194 | A | | 10/1993 | Ott et al. |
| 5,376,428 | A | | 12/1994 | Palazzotto et al. |
| 5,385,954 | A | | 1/1995 | Palazzotto et al. |
| 5,435,816 | A | | 7/1995 | Spurgeon et al. |
| 5,454,844 | A | | 10/1995 | Hibbard et al. |
| 5,672,097 | A | | 9/1997 | Hoopman |
| 5,672,186 | A | | 9/1997 | Chesley et al. |
| 5,681,217 | A | * | 10/1997 | Hoopman et al. ..... 451/528 |
| 5,692,950 | A | | 12/1997 | Rutherford et al. |
| 5,833,724 | A | | 11/1998 | Wei et al. |
| 5,851,247 | A | | 12/1998 | Stoetze et al. |
| 5,863,306 | A | * | 1/1999 | Wei et al. ..... 51/295 |
| 5,908,476 | A | | 6/1999 | Nishio et al. |
| 5,928,394 | A | | 7/1999 | Stoetzel |
| 6,048,375 | A | | 4/2000 | Yang et al. |
| 6,139,594 | A | | 10/2000 | Kincaid et al. |

(Continued)

OTHER PUBLICATIONS

International Search Report, PCT/US2010/046573, mailed May 3, 2011, 3 pages.

(Continued)

*Primary Examiner* — Maurina Rachuba
(74) *Attorney, Agent, or Firm* — Bradford B. Wright

(57) ABSTRACT

A structured abrasive article comprises a backing, and an abrasive layer disposed on and secured to the backing. The abrasive layer comprises shaped abrasive composites, each comprising abrasive particles dispersed in a binder. Each the shaped abrasive composites independently comprises: a base disposed on the backing; a plurality of walls extending away from the base, and a grinding surface not contacting the base. Adjacent walls share a common edge. Each wall independently forms a dihedral angle with the base of less than or equal to 90 degrees. The grinding surface has a plurality of: cusps, and facets that contact a recessed feature. At least a portion of the recessed feature is disposed closer to the base than each of the cusps. Each cusp is formed by an intersection of two of the walls and at least one of the facets. Use of the structured abrasive article to abrade a workpiece is also disclosed.

23 Claims, 3 Drawing Sheets

U.S. PATENT DOCUMENTS

| | | | | |
|---|---|---|---|---|
| 6,293,980 | B2 | 9/2001 | Wei et al. | |
| 6,949,128 | B2 | 9/2005 | Annen | |
| 7,267,700 | B2 * | 9/2007 | Collins et al. | 51/298 |
| 7,297,170 | B2 | 11/2007 | Welygan et al. | |
| 7,300,479 | B2 * | 11/2007 | McArdle et al. | 51/298 |
| 7,410,413 | B2 | 8/2008 | Woo et al. | |
| 7,553,346 | B2 | 6/2009 | Welygan et al. | |
| 2001/0041511 | A1 | 11/2001 | Lack et al. | |
| 2002/0187735 | A1 * | 12/2002 | Nabeya | 451/67 |
| 2003/0022604 | A1 | 1/2003 | Annen et al. | |
| 2003/0143938 | A1 | 7/2003 | Braunschweig et al. | |
| 2005/0060945 | A1 | 3/2005 | Culler et al. | |
| 2005/0064805 | A1 | 3/2005 | Culler et al. | |
| 2006/0246831 | A1 | 11/2006 | Bonner et al. | |
| 2007/0128991 | A1 * | 6/2007 | Yoon et al. | 451/56 |
| 2007/0243798 | A1 | 10/2007 | Annen et al. | |
| 2009/0017727 | A1 | 1/2009 | Pribyl et al. | |

OTHER PUBLICATIONS

Written Opinion of the International Searching Authority, PCT/US2010/046573, mailed May 3, 2011, 3 pages.

* cited by examiner

STRUCTURED ABRASIVE ARTICLE AND METHOD OF USING THE SAME

FIELD

The present disclosure broadly relates to the field of coated abrasives, and methods of using them.

BACKGROUND

Structured abrasive articles are a specific type of coated abrasive article that typically has a plurality of shaped abrasive composites secured to a backing. Each shaped abrasive composite has a base in contact with the backing and a distal end that extends outwardly from the backing. The shaped abrasive composites comprise abrasive particles dispersed in a binder, typically a polymeric binder. The shaped abrasive composites are usually arranged in a close packed array. In one common configuration of a structured abrasive article, the shaped abrasive composites are pyramidal (e.g., tetrahedral or square pyramidal).

Traditionally, structured abrasive products such as, for example, those available as TRIZACT from 3M Company of St. Paul, Minn., have utilized pyramidal abrasive composites. Pyramids are typically used for a variety of reasons, not all of them based on grinding performance. For example, pyramids are an easy shape to produce in the tooling used in the manufacture of the structured abrasive products. Further, during manufacture, the tooling is typically relatively easy to fill with curable slurry and separate from the structured abrasive article after curing when pyramids are used.

A characteristic of pyramidal abrasive composites is a change in load-bearing area from the tops of the shaped composites to their bases as they erode during use. Initially, the erosion is rather rapid. With continued use the load-bearing area increases until it reaches a point beyond which it no longer breaks down and stops efficiently abrading. This usually occurs when the load-bearing area is in a range of from fifty to seventy percent of the area of the working abrasive surface. In practice, this has limited the useful life of structured abrasive articles incorporating pyramidal shaped features.

SUMMARY

In one aspect, the present disclosure provides a structured abrasive article comprising:

a backing having first and second opposed major surfaces; and an abrasive layer disposed on and secured to the first major surface, wherein the abrasive layer comprises shaped abrasive composites, wherein each of the shaped abrasive composites comprises abrasive particles dispersed in a polymeric binder, and wherein each of the shaped abrasive composites independently comprises:

a base disposed on the backing;

a plurality of walls extending away from the base, wherein adjacent walls share a common edge, wherein each wall independently forms a first dihedral angle with the base of less than or equal to 90 degrees; and a grinding surface not in contact with the base, wherein the grinding surface has:

a plurality of cusps; and a plurality of facets that contact a recessed feature capable of being contained within a geometric plane, wherein at least a portion of the recessed feature is disposed closer to the base than each of the cusps, and wherein each cusp is formed by an intersection of two of the walls and at least one of the facets.

In some embodiments, the recessed feature is a polygon. In some embodiments, the recessed feature is a line. In the foregoing embodiments, the recessed feature may be sloped relative to the base. In some embodiments, the recessed feature is a point.

The following embodiments may be used in any combination. In some embodiments, each of the walls is perpendicular to the base. In some embodiments, the first dihedral angle is in a range of from 80 to 85 degrees. In some embodiments, each of the cusps is substantially equidistant from the base. In some embodiments, relative to its base, each of the shaped abrasive composites has a height, and wherein the recessed feature has a lowest point that is higher than half of the height. In some embodiments, each of the shaped abrasive composites independently has three, four, or six walls (e.g., four). In some embodiments, the base is substantially square. In some embodiments, the shaped abrasive composites do not contact one another. In some embodiments, the shaped abrasive composites are separated by a plurality of linear channels extending across the first surface of the backing. In some embodiments, the shaped abrasive composites collectively comprise a close-packed array. In some embodiments, at least some of the facets contacting adjacent cusps independently define a second dihedral angle in a range of from 120 to 135 degrees.

In some embodiments, each of the shaped abrasive composites has substantially the same size and shape. In some embodiments, the structured abrasive article further comprises a supersize disposed on the abrasive layer. In some embodiments, the structured abrasive article further comprises an attachment interface layer disposed on the second major surface. In some embodiments, the structured abrasive article has a load-bearing area in a range of from 50 to 70 percent.

In some embodiments, the shaped abrasive composites have a base with sides in a range of from 30 to 60 mils (0.76 to 1.5 millimeter) and a maximum height in a range of from 15 to 30 mils (0.38 to 0.76 millimeter);

facets contacting adjacent cusps independently define a dihedral angle in a range of from 120 to 135 degrees;

the sidewalls independently form a respective dihedral angle with the base in a range of from 78 to 90 degrees;

the shaped abrasive composites are separated by a plurality of linear channels extending across the first surface of the backing, wherein the channels have a width in a range of from 10 to 30 mils (0.25 to 0.76 millimeter); and relative to its base, each of the shaped abrasive composites has a height, and wherein the recessed feature has a lowest point that has a height in a range of from 40 to 80 percent of the height of the shaped abrasive composite.

The foregoing embodiments may be used in any combination not otherwise inconsistent with the present disclosure.

In another aspect, the present disclosure provides a method of abrading a workpiece, the method comprising: frictionally contacting at least a portion of the abrasive layer of the structured abrasive article of any one of claims 1 to 19 with a surface of the workpiece; and moving at least one of the workpiece or the abrasive layer relative to the other to abrade at least a portion of the surface of the workpiece.

The present disclosure addresses the dual problems of changing abrasive performance and initial cut. Advantageously, by modifying the shape of the shaped abrasive composite in accordance of the present disclosure, the usefulness of structured abrasive articles can be extended well beyond the current service life of comparable commercially available products, while achieving a comparable initial cut rate to those products.

As used herein:

the term "cusp" refers to a point formed by facets and walls that represents a local maximum height relative to the base;

the term "facet" refers to a polygonal surface that does not contact the base of a shaped abrasive composite;

the term "polygonal" refers to a closed plane figure bounded by straight lines; and the term "wall" refers to a face of a shaped abrasive composite that contacts the base and the grinding surface.

BRIEF DESCRIPTION OF THE DRAWINGS

In the following figures, it will be appreciated that features are shown for purposes of illustrating the present disclosure, and are not necessarily drawn to scale.

DETAILED DESCRIPTION

Figure 1:
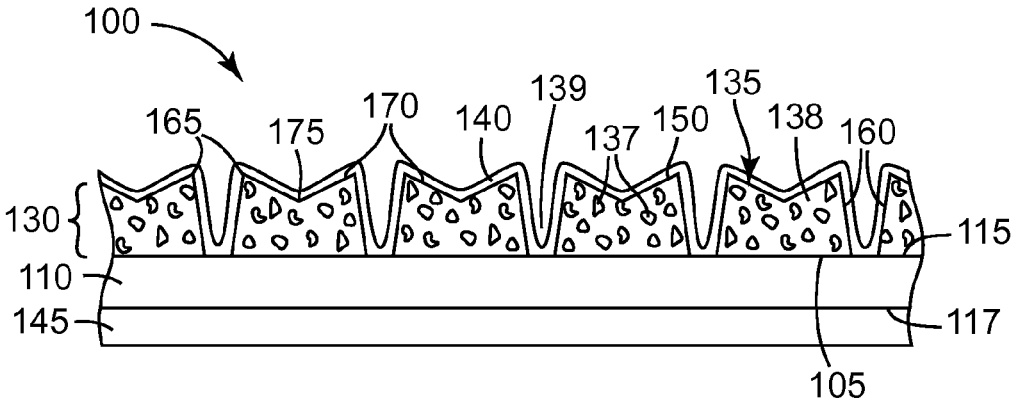
FIG. 1 is a schematic side view of an exemplary structured abrasive article 100 according to the present disclosure.

Referring now to FIG. 1, exemplary structured abrasive article 100 comprises backing 110, which has respective first and second major surfaces 115, 117. Abrasive layer 130 contacts and is secured to first major surface 115. Abrasive layer 130 comprises a plurality of shaped abrasive composites 135, each having grinding surface 150, base 105, and walls 160, that are separated by optional channels 139. Each grinding surface independently comprises cusps 165, facets 170, and a central feature 175. Shaped abrasive composites 135 comprise abrasive particles 137 dispersed in a polymeric binder 138. Optional supersize 140 is disposed on abrasive layer 130 opposite backing 110. Optional attachment interface layer 145 is disposed on second major surface 117.

While the channels 139 may be essentially devoid of abrasive material as shown in FIG. 1, they may also be covered by a layer (typically a thin layer) of abrasive material.

Figure 2:
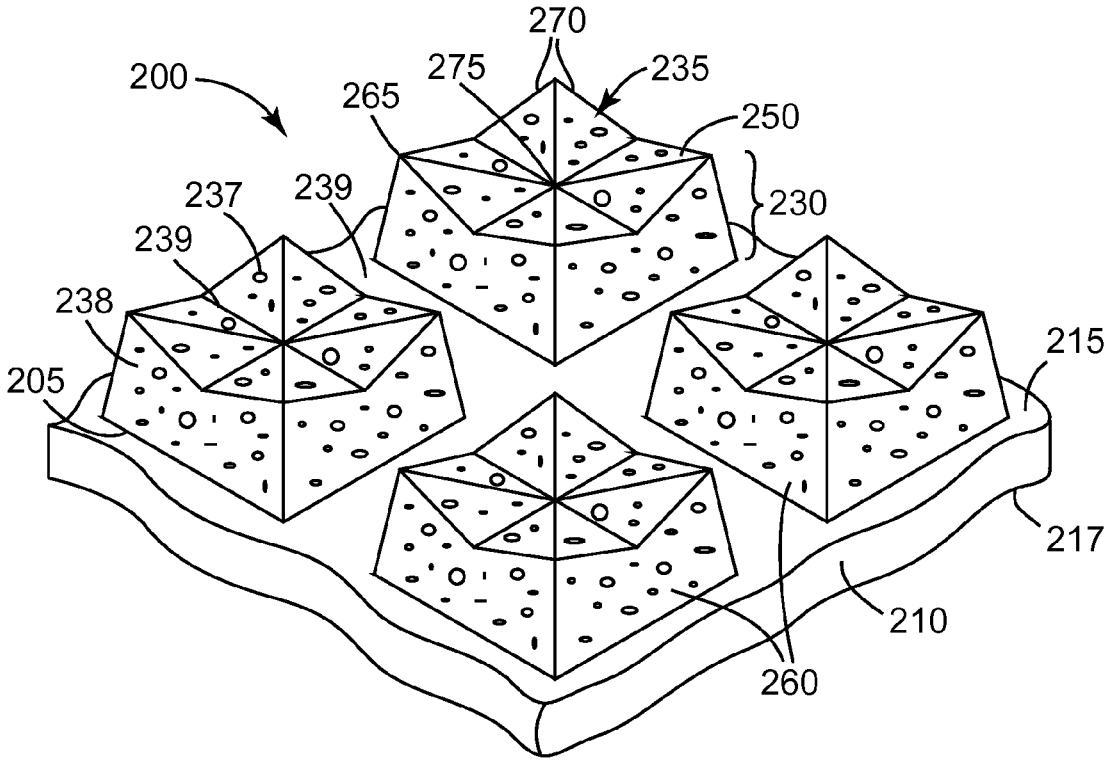
FIG. 2 is a schematic perspective view of an exemplary structured abrasive article 200 according to the present disclosure.

FIG. 2 shows the surface topography of one embodiment of structured abrasive article 200. Accordingly, structured abrasive article 200 comprises backing 210, which has respective first and second major surfaces 215, 217. Abrasive layer 230 contacts and is secured to first major surface 215. Abrasive layer 230 comprises a plurality of shaped abrasive composites 235, each having grinding surface 250, base 205, and walls 260, that are separated by optional channels 239. Each of the grinding surfaces 250 comprises cusps 265, facets 270, and a central feature 275. As shown, shaped abrasive composites 235 are precisely-shaped, although this is not a requirement. Shaped abrasive composites 235 comprise abrasive particles 237 dispersed in polymeric binder 238. The shaped abrasive composites shown in FIG. 2 correspond to that shown in FIG. 4, discussed hereinbelow.

Each of the shaped abrasive composites comprises a base disposed on the backing. The base, which is typically planar, may have any polygonal shape. For example, it may be triangular, square, rectangular, or hexagonal. Plural walls extend away from the base. The walls may comprise planar and/or curved portions. For example, the walls may be planar. Adjacent walls share a common edge. Individual walls may be vertical (i.e., forming a dihedral angle of 90 degrees with the base), or they may be sloped inward such that the walls independently form dihedral angles with the base of less than 90 degrees (e.g., as in the case of a pyramid).

Each of the shaped abrasive composites has a grinding surface that is not in contact with the base. The grinding surface, which does not contact the base, has a plurality of cusps and a plurality of facets and a recessed feature.

Each cusp is formed by an intersection of two of the walls and at least one of the facets. In some embodiments, each cusp is formed by an intersection of two walls and two facets. In general, at least some of the facets (e.g., all of the facets) contacting adjacent cusps independently define a second dihedral angle in a range of from 120 to 135 degrees. This second dihedral angle may have any value greater than zero degrees and less than 180 degrees; typically, in a range of from 90 degrees to 150 degrees; and more typically in a range of from 120 to 135 degrees. The cusps may be equidistant from the base (i.e., have the same height) or at least some of the cusps may have different heights.

The facets contact a recessed feature such that each of the cusps is disposed further from the base than at least a portion of the recessed feature. The facets may comprise planar and/or curved portions. For example, the facets may be planar. The facets may be identical, different, or a combination thereof. In some embodiments, the number of facets and cusps is equal to or twice the number of cusps.

The recessed feature is capable of being contained within, a geometric plane. For example, the recessed feature may be a point, a line, or a polygon. If the recessed feature is a line or polygon, it may be sloped relative to the base; for example, as in the instance where the cusps have different heights relative to the base.

The facets, cusps, and recessed feature may be arranged in any manner that meets the specified criteria herein.

In the figures, the cusps are shown as sharp points and the edges as sharp lines, however it is contemplated that the cusps and edges (and other features) may be somewhat rounded, whether by design and/or as a result of manufacturing, provided that they are readily discernible.

Various illustrative embodiments of shaped abrasive composites are shown in FIGS. 3A to 6B.

Figure 3A:
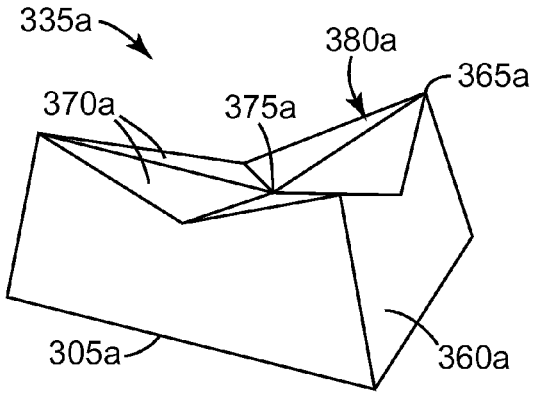
FIGS. 3A to 3C are perspective schematic views of exemplary shaped abrasive composites having vertical walls.
Figure 3B:
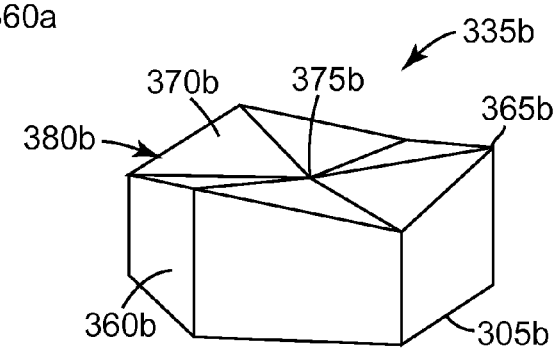
Figure 3C:
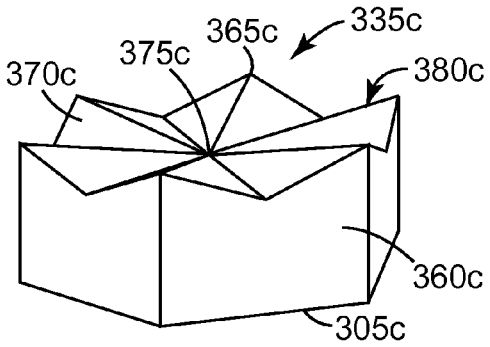

Referring now to FIGS. 3A to 3C, shaped abrasive composites 335*a*, 335*b*, 335*c* have, respectively: base 305*a*, 305*b*, 305*c*; vertical walls 360*a*, 360*b*, 360*c*; cusps 365*a*, 365*b*, 365*c*; facets 370*a*, 370*b*, 370*c*; grinding surfaces 380*a*, 380*b*, 380*c*; and recessed features (points) 375*a*, 375*b*, 375*c*.

Figure 4:
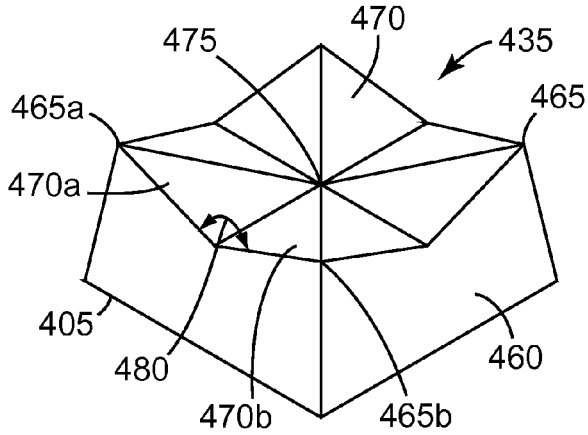
FIG. 4 is a perspective schematic view of an exemplary shaped abrasive composite wherein the recessed feature is a point.

Referring now to FIG. 4, shaped abrasive composite 435 has base 405, four inwardly sloping walls 460; four cusps 465; and eight facets 470 that contact recessed feature (point) 475. Dihedral angle 480 is formed by facets 470*a*, 470*b* contacting adjacent cusps 465*a*, 465*b*.

Figure 5A:
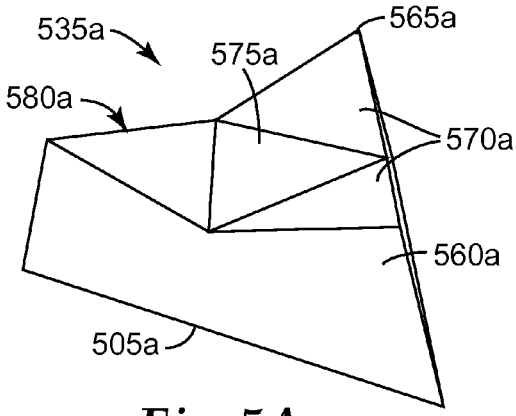
FIGS. 5A to 5B are perspective schematic views of exemplary shaped abrasive composites wherein the recessed feature is a polygon.
Figure 5B:
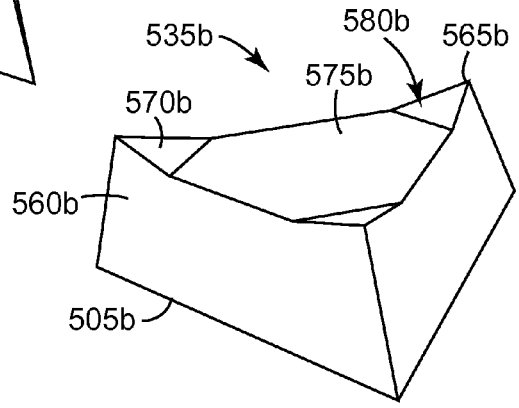

Referring now to FIGS. 5A and 5B, shaped abrasive composites 535*a*, 535*b* have, respectively: base 505*a*, 505*b*; vertical walls 560*a*, 560*b*; cusps 565*a*, 565*b*; facets 570*a*, 570*b*; grinding surface 580*a*, 580*b*; and recessed features (polygons) 575*a*, 575*b*.

Figure 6A:
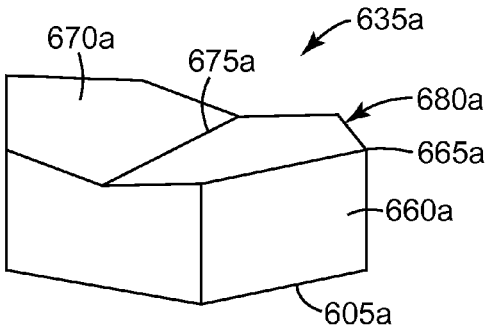
FIGS. 6A and 6B are perspective schematic views of exemplary shaped abrasive composites wherein the recessed feature is a line.
Figure 6B:
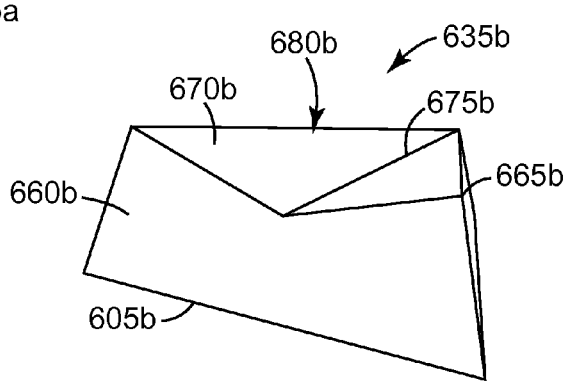

Referring now to FIGS. 6A and 613, shaped abrasive composites 635*a*, 635*b* have, respectively: base 605*a*, 605*b*; sloped walls 660*a*, 660*b*; cusps 665*a*, 665*b*; facets 670*a*, 670*b*; grinding surface 680*a*, 680*b*; and recessed features (lines) 675*a*, 675*b*.

Examples of useful backings include films, foams (open cell or closed cell), papers, foils, and fabrics. The backing may be, for example, a thermoplastic film that includes a thermoplastic polymer, which may contain various additive (s). Examples of suitable additives include colorants, processing aids, reinforcing fibers, heat stabilizers, UV stabilizers, and antioxidants. Examples of useful fillers include clays, calcium carbonate, glass beads, talc, clays, mica, wood flour; and carbon black. The backing may be a composite film, for example a coextruded film having two or more discrete layers.

Suitable thermoplastic polymers include, for example, polyolefins (e.g., polyethylene, and polypropylene), polyesters (e.g., polyethylene terephthalate), polyamides (e.g., nylon-6 and nylon-6,6), polyimides, polycarbonates, and combinations and blends thereof.

Typically, the average thickness of the backing is in a range of from at least 1 mil (25 micrometers) to 100 mils (2500 micrometers), although thicknesses outside of this range may also be used.

The abrasive layer comprises shaped abrasive composites, each comprising abrasive particles dispersed in a polymeric binder. The structured abrasive layer may be continuous or discontinuous, for example, it may have regions devoid of shaped abrasive composites. Typically, the shaped abrasive composites are arranged on the backing according to a predetermined pattern or array, although this is not a requirement. The shaped abrasive composites may have substantially identical shapes and/or sizes or a mixture of various shapes and/or sizes. Typically, essentially all of the shaped abrasive composites in the abrasive layer have the same size and shape, allowing for manufacturing tolerances (e.g., with respect to missing portions of some shaped abrasive composites or excess material that may be present), although different shapes and sizes are also permissible.

Typically, the shaped abrasive composites are "precisely-shaped" abrasive composites, although this is not a requirement. This means that the shaped abrasive composites are defined by relatively smooth surfaced sides that are bounded and joined by well-defined edges having distinct edge lengths with distinct endpoints defined by the intersections of the various sides. The terms "bounded" and "boundary" refer to the exposed surfaces and edges of each composite that delimit and define the actual three-dimensional shape of each shaped abrasive composite. These boundaries are readily visible and discernible when a cross-section of an abrasive article is viewed under a scanning electron microscope. These boundaries separate and distinguish one precisely-shaped abrasive composite from another even if the composites abut each other along a common border at their bases. By comparison, in a shaped abrasive composite that does not have a precise shape, the boundaries and edges are not well-defined (e.g., where the abrasive composite sags before completion of its curing).

The abrasive layer comprises shaped abrasive composites, typically including at least some precisely-shaped abrasive composites, although this is not a requirement. At least some of the abrasive composites comprise a base, walls, and a grinding surface comprising cusps, and facets. In some embodiments, the number of facets is twice the number of cusps. In some embodiments, the shaped abrasive composites have substantially the same size and shape, although they may be different. The walls of individual shaped abrasive composites may have the same size and/or shape, although they may be different. The facets of individual shaped abrasive composites may have the same size and/or shape, although they may be different. The cusps of individual shaped abrasive composites may have the same size and/or shape, although they may be different. The cusps of individual shaped abrasive composites may be equidistant from the base, or they may have different heights. In some embodiments, they may have different sizes and/or shapes.

The walls may be sloped such that the dihedral angle formed by any given wall and the base is in a range of from about 20 to 90 degrees, typically in a range of from about 80 to 87 degrees, more typically in a range of from about 83 to 85 degrees, although other angles may also be used.

Likewise, facets contacting adjacent cusps may independently define dihedral angles in a range of from 120 to 135 degrees, more typically 125 to 130 degrees, although other angles may be used.

In some embodiments, the shaped abrasive composites in the abrasive layer consist essentially (i.e., other than shapes due to manufacturing defects) of the shaped abrasive composites described above.

Advantageously, shaped abrasive composites constructed as above may be formed such that they exhibit minimal change in load-bearing area after a period of initial use, while simultaneously providing sufficient abrasive points and edges (cusps and facet joint ridges) that a sufficient degree of initial cut is also achieved. While not wishing to be bound by theory, the present inventors believe that erosion of the relatively weak cusps is desirable in that it exposes mineral at the grinding surface that would otherwise be covered by a layer of polymeric binder, thereby contributing to initial cut performance. Accordingly, were the shaped abrasive composites to have flat tops, poor initial cut would be expected.

The foregoing shaped abrasive composites may be combined with abrasive composites having different shapes. Examples include pyramids (e.g., three-sided pyramids or four-sided pyramids), prisms, and rods.

The shaped abrasive composites may comprise a close packed array; however, it is presently found that by separating the shaped abrasive composites it is possible to control the load-bearing area of the structured abrasive article. As used herein, the term "load-bearing area", expressed as a percentage, refers to the combined area of all bases of all shaped abrasive composites divided by the total area of the first surface of the backing. Typically, the load-bearing area is in a range of from 30 to 100 percent, more typically in a range of from 40 to 80 percent, and still more typically in a range of from 50 to 70 percent, although this is not a requirement. Load-bearing areas less than 100 percent may be achieved, for example, by including channels between individual shaped abrasive composites, or between close packed arrays of the shaped abrasive composites.

For fine finishing applications, the height of the shaped abrasive composites is generally greater than or equal to one micrometer and less than or equal to 20 mils (510 micrometers); for example, less than 15 mils (380 micrometers), 10 mils (200 micrometers), 5 mils (200 micrometers), 2 mils (5 micrometers), or even less than one mil, although greater and lesser heights may also be used.

For fine finishing applications, the areal density of shaped abrasive composites in the abrasive layer is typically in a range of from at least 1,000, 10,000, or even at least 20,000 shaped abrasive composites per square inch (e.g., at least 150, 1,500, or even 7,800 shaped abrasive composites per square centimeter) up to and including 50,000, 70,000, or even as many as 100,000 shaped abrasive composites per square inch (7,800, 11,000, or even as many as 15,000 shaped abrasive composites per square centimeter), although greater or lesser densities of shaped abrasive composites may also be used.

Any abrasive particle may be included in the abrasive composites. Typically, the abrasive particles have a Mohs' hardness of at least 8, or even 9. Examples of such abrasive particles include aluminum oxide, fused aluminum oxide, ceramic aluminum oxide, white fused aluminum oxide, heat treated aluminum oxide, silica, silicon carbide, green silicon carbide, alumina zirconia, diamond, iron oxide, ceria, cubic boron nitride, garnet, tripoli, sol-gel derived abrasive particles, and combinations thereof.

Typically, the abrasive particles have an average particle size of less than or equal to 1500 micrometers, although average particle sizes outside of this range may also be used. For repair and finishing applications, useful abrasive particle sizes typically range from an average particle size in a range of from at least 0.01, 1, 3 or even 5 micrometers up to and including 35, 100, 250, 500, or even as much as 1500 micrometers.

The abrasive particles are dispersed in a polymeric binder, which may be thermoplastic and/or crosslinked. This is generally accomplished by dispersing the abrasive particles in a binder precursor usually in the presence of an appropriate curative (e.g., photoinitiator, thermal curative, and/or catalyst). Examples of suitable polymeric binders that are useful in abrasive composites include phenolics, aminoplasts, urethanes, epoxies, acrylics, cyanates, isocyanurates, glue, and combinations thereof.

Typically, the polymeric binder is prepared by crosslinking (e.g., at least partially curing and/or polymerizing) a binder precursor. During the manufacture of the structured abrasive article, the polymeric binder precursor is exposed to an energy source which aids in the initiation of polymerization (typically including crosslinking) of the binder precursor. Examples of energy sources include thermal energy and radiation energy which includes electron beam, ultraviolet light, and visible light. In the case of an electron beam energy source, curative is not necessarily required because the electron beam itself generates free radicals.

After this polymerization process, the binder precursor is converted into a solidified binder. Alternatively for a thermoplastic binder precursor, during the manufacture of the abrasive article the thermoplastic binder precursor is cooled to a degree that results in solidification of the binder precursor. Upon solidification of the binder precursor, the abrasive composite is formed.

There are two main classes of polymerizable resins that may be included in the binder precursor, condensation polymerizable resins and addition polymerizable resins. Addition polymerizable resins are advantageous because they are readily cured by exposure to radiation energy. Addition polymerized resins can polymerize, for example, through a cationic mechanism or a free-radical mechanism. Depending upon the energy source that is utilized and the binder precursor chemistry, a curing agent, initiator, or catalyst may be useful to help initiate the polymerization.

Examples of typical binder precursors include phenolic resins, urea-formaldehyde resins, aminoplast resins, urethane resins, melamine formaldehyde resins, cyanate resins, isocyanurate resins, (meth)acrylate resins (e.g., (meth)acrylated urethanes, (meth)acrylated epoxies, ethylenically-unsaturated free-radically polymerizable compounds, aminoplast derivatives having pendant alpha, beta-unsaturated carbonyl groups, isocyanurate derivatives having at least one pendant acrylate group, and isocyanate derivatives having at least one pendant acrylate group) vinyl ethers, epoxy resins, and mixtures and combinations thereof. As used herein, the term "(meth)acryl" encompasses acryl and methacryl.

Phenolic resins have good thermal properties, availability, and relatively low cost and ease of handling. There are two types of phenolic resins, resole and novolac. Resole phenolic resins have a molar ratio of formaldehyde to phenol of greater than or equal to one to one, typically in a range of from 1.5:1.0 to 3.0:1.0. Novolac resins have a molar ratio of formaldehyde to phenol of less than one to one. Examples of commercially available phenolic resins include those known by the trade designations DUREZ and VARCUM from Occidental Chemicals Corp. of Dallas, Tex.; RESINOX from Monsanto Co. of Saint Louis, Mo.; and AEROFENE and AROTAP from Ashland Specialty Chemical Co. of Dublin, Ohio.

(Meth)acrylated urethanes include di(meth)acrylate esters of hydroxyl-terminated NCO extended polyesters or polyethers. Examples of commercially available acrylated urethanes include those available as CMD 6600, CMD 8400, and CMD 8805 from Cytec Industries of West Paterson, N.J.

(Meth)acrylated epoxies include di(meth)acrylate esters of epoxy resins such as the diacrylate esters of bisphenol A epoxy resin. Examples of commercially available acrylated epoxies include those available as CMD 3500, CMD 3600, and CMD 3700 from Cytec Industries.

Ethylenically-unsaturated free-radically polymerizable compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically-unsaturated free-radically polymerizable compounds typically have a molecular weight of less than about 4,000 g/mole and are typically esters made from the reaction of compounds containing a single aliphatic hydroxyl group or multiple aliphatic hydroxyl groups and unsaturated carboxylic acids, such as acrylic acid, methacrylic acid, itaconic acid, crotonic acid, isocrotonic acid, maleic acid, and the like. Representative examples of (meth)acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl) isocyanurate, 1,3,5-tris(2-methyacryloxyethyl)-s-triazine, acrylamide, N-methylacrylamide, N,N-dimethylacrylamide, N-vinylpyrrolidone, and N-vinylpiperidone.

Useful aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho- and para-acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group and isocyanate derivatives having at least one pendant acrylate group are further described in U.S. Pat. No.

4,652,274 (Boettcher et al.). An example of one isocyanurate material is the triacrylate of tris(hydroxyethyl) isocyanurate.

Epoxy resins have one or more epoxy groups that may be polymerized by ring opening of the epoxy group(s). Such epoxy resins include monomeric epoxy resins and oligomeric epoxy resins. Examples of useful epoxy resins include 2,2-bis[4-(2,3-epoxypropoxy)-phenyl propane] (diglycidyl ether of bisphenol) and materials available as EPON 828, EPON 1004, and EPON 1001F from Shell Chemical Co. of Houston, Tex.; and DER-331, DER-332, and DER-334 from Dow Chemical Co. of Midland, Mich. Other suitable epoxy resins include glycidyl ethers of phenol formaldehyde novolac commercially available as DEN-431 and DEN-428 from Dow Chemical Co.

The epoxy resins can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other curing agents (e.g., amine hardeners and guanidines) for epoxy resins and phenolic resins may also be used.

Other cationic curing agents include a salt having an organometallic complex cation and a halogen containing complex anion of a metal or metalloid which are further described in U.S. Pat. No. 4,751,138 (Tumey et al.). Another example is an organometallic salt and an onium salt is described in U.S. Pat. No. 4,985,340 (Palazzotto et al.); U.S. Pat. No. 5,086,086 (Brown-Wensley et al.); and U.S. Pat. No. 5,376,428 (Palazzotto et al.). Still other cationic curing agents include an ionic salt of an organometallic complex in which the metal is selected from the elements of Periodic Group IVB, VB, VIB, VIIB and VIIIB which is described in U.S. Pat. No. 5,385,954 (Palazzotto et al.).

Examples of free radical thermal initiators include peroxides, e.g., benzoyl peroxide and azo compounds.

Compounds that generate a free radical source if exposed to actinic electromagnetic radiation are generally termed photoinitiators. Examples of photoinitiators include benzoin and its derivatives such as alpha-methylbenzoin; alpha-phenylbenzoin; alpha-allylbenzoin; alpha-benzylbenzoin; benzoin ethers such as benzil dimethyl ketal (e.g., as commercially available as IRGACURE 651 from Ciba Specialty Chemicals of Tarrytown, N.Y.), benzoin methyl ether, benzoin ethyl ether, benzoin n-butyl ether; acetophenone and its derivatives such as 2-hydroxy-2-methyl-1-phenyl-1-propanone (e.g., as DAROCUR 1173 from Ciba Specialty Chemicals) and 1-hydroxycyclohexyl phenyl ketone (e.g., as IRGACURE 184 from Ciba Specialty Chemicals); 2-methyl-1-[4-(methylthio) phenyl]-2-(4-morpholinyl)-1-propanone (e.g., as IRGACURE 907 from Ciba Specialty Chemicals; 2-benzyl-2-(dimethylamino)-1-[4-(4-morpholinyl)phenyl]-1-butanone (e.g., as IRGACURE 369 from Ciba Specialty Chemicals). Other useful photoinitiators include, for example, pivaloin ethyl ether, anisoin ethyl ether, anthraquinones (e.g., anthraquinone, 2-ethylanthraquinone, 1-chloroanthraquinone, 1,4-dimethylanthraquinone, 1-methoxyanthraquinone, or benzanthraquinone), halomethyltriazines, benzophenone and its derivatives, iodonium salts and sulfonium salts, titanium complexes such as bis(eta.sub.5-2,4-cyclopentadien-1-yl)-bis[2,6-difluoro-3-(1H-pyrrol-1-yl)phenyl]titanium (e.g., as CGI 784DC from Ciba Specialty Chemicals); halonitrobenzenes (e.g., 4-bromomethylnitrobenzene), mono- and bis-acylphosphines (e.g., as IRGACURE 1700, IRGACURE 1800, IRGACURE 1850, and DAROCUR 4265 all from Ciba Specialty Chemicals). Combinations of photoinitiators may be used. One or more spectral sensitizers (e.g., dyes) may be used in conjunction with the photoinitiator(s), for example, in order to increase sensitivity of the photoinitiator to a specific source of actinic radiation.

To promote an association bridge between the abovementioned binder and the abrasive particles, a silane coupling agent may be included in the slurry of abrasive particles and binder precursor; typically in an amount of from about 0.01 to 5 percent by weight, more typically in an amount of from about 0.01 to 3 percent by weight, more typically in an amount of from about 0.01 to 1 percent by weight, although other amounts may also be used, for example depending on the size of the abrasive particles. Suitable silane coupling agents include, for example, methacryloxypropylsilane, vinyltriethoxysilane, vinyltris(2-methoxyethoxy)silane, 3,4-epoxycyclohexylmethyltrimethoxysilane, gamma-glycidoxypropyltrimethoxysilane, and gamma-mercaptopropyltrimethoxysilane (e.g., as available under the respective trade designations A-174, A-151, A-172, A-186, A-187, and A-189 from Witco Corp. of Greenwich, Conn.), allyltriethoxysilane, diallyldichlorosilane, divinyldiethoxysilane, and meta, para-styrylethyltrimethoxysilane (e.g., as commercially available under the respective trade designations A0564, D4050, D6205, and S 1588 from United Chemical Industries of Bristol, Pa.), dimethyldiethoxysilane, dihydroxydiphenylsilane, triethoxysilane, trimethoxysilane, triethoxysilanol, 3-(2-aminoethylamino)propyltrimethoxysilane, methyltrimethoxysilane, vinyltriacetoxysilane, methyltriethoxysilane, tetraethyl orthosilicate, tetramethyl orthosilicate, ethyltriethoxysilane, amyltriethoxysilane, ethyltrichlorosilane, amyltrichlorosilane, phenyltrichlorosilane, phenyltriethoxysilane, methyltrichlorosilane, methyldichlorosilane, dimethyldichlorosilane, dimethyldiethoxysilane, and mixtures thereof.

The binder precursor may optionally contain additives such as, for example, colorants, grinding aids, fillers, wetting agents, dispersing agents, light stabilizers, and antioxidants.

Grinding aids, which may optionally be included in the abrasive layer via the binder precursor, encompass a wide variety of different materials including both organic and inorganic compounds. A sampling of chemical compounds effective as grinding aids includes waxes, organic halide compounds, halide salts, metals and metal alloys. Specific waxes effective as a grinding aid include specifically, but not exclusively, the halogenated waxes tetrachloronaphthalene and pentachloronaphthalene. Other effective grinding aids include halogenated thermoplastics, sulfonated thermoplastics, waxes, halogenated waxes, sulfonated waxes, and mixtures thereof. Other organic materials effective as a grinding aid include specifically, but not exclusively, polyvinylchloride and polyvinylidene chloride. Examples of halide salts generally effective as a grinding aid include sodium chloride, potassium cryolite, sodium cryolite, ammonium cryolite, potassium tetrafluoroborate, sodium tetrafluoroborate, silicon fluorides, potassium chloride, and magnesium chloride. Halide salts employed as a grinding aid typically have an average particle size of less than 100 mm, with particles of less than 25 mm preferred. Examples of metals generally effective as a grinding aid include antimony, bismuth, cadmium, cobalt, iron, lead, tin, and titanium. Other commonly used grinding aids include sulfur, organic sulfur compounds, graphite, and metallic sulfides. Combinations of these grinding aids can also be employed.

The optional supersize, if present, is disposed on at least a portion of the abrasive layer. For example, a supersize may be disposed only on the shaped abrasive composites (e.g., on their grinding surfaces), although it may also be disposed on the channels. Examples of supersizes include one or more compounds selected from the group consisting of secondary grinding aids such as alkali metal tetrafluoroborate salts, metal salts of fatty acids (e.g., zinc stearate or calcium stearate), and salts of phosphate esters (e.g., potassium behenyl phosphate), phosphate esters, urea-formaldehyde resins, mineral oils, crosslinked silanes, crosslinked silicones, and/or fluorochemicals; fibrous materials; antistatic agents; lubricants; surfactants; pigments; dyes; coupling agents; plasticizers: antiloading agents; release agents; suspending agents; rheology modifiers; curing agents; and mixtures thereof. A secondary grinding aid is preferably selected from the group of sodium chloride, potassium aluminum hexafluoride, sodium aluminum hexafluoride, ammonium aluminum hexafluoride, potassium tetrafluoroborate, sodium tetrafluoroborate, silicon fluorides, potassium chloride, magnesium chloride, and mixtures thereof. In some embodiments, one or more metal salts of fatty acids (e.g., zinc stearate) may be usefully included in the supersize.

The structured abrasive article may optionally include an attachment interface layer such as, for example, a hooked film, looped fabric, or pressure-sensitive adhesive that affixes the structured abrasive article to a tool or back up pad during use.

Useful pressure-sensitive adhesives (PSAs) include, for example, hot melt PSAs, solvent-based PSAs, and latex-based PSAs. Pressure-sensitive adhesives are widely commercially available; for example, from 3M Company of Saint Paul, Minn. The PSA layer, if present may be coated onto the backing any suitable technique including, for example, spraying, knife coating, and extrusion coating. In some embodiments, a release liner may be disposed on the pressure-sensitive layer to protect it prior to use. Examples of release liners include polyolefin films and siliconized papers.

Structured abrasive articles according to the present disclosure may be prepared by forming a slurry of abrasive grains and a solidifiable or polymerizable precursor of the abovementioned binder resin (i.e., a binder precursor), contacting the slurry with a backing (or if present, optional adhesive layer) and at least partially curing the binder precursor (e.g., by exposure to an energy source) in a manner such that the resulting structured abrasive article has a plurality of shaped abrasive composites affixed to the backing. Examples of energy sources include thermal energy and radiant energy (including electron beam, ultraviolet light, and visible light).

In one embodiment, a slurry of abrasive particles in a binder precursor may be coated directly onto a production tool having precisely-shaped cavities therein and brought into contact with the backing (or if present, optional adhesive layer), or coated on the backing and brought to contact with the production tool. In this embodiment, the slurry is typically then solidified (e.g., at least partially cured) while it is present in the cavities of the production tool.

The production tool can be a belt, a sheet, a continuous sheet or web, a coating roll such as a rotogravure roll, a sleeve mounted on a coating roll, or die. The production tool can be composed of metal (e.g., nickel), metal alloys, or plastic. The metal production tool can be fabricated by any conventional technique such as, for example, engraving, bobbing, electroforming, or diamond turning. A thermoplastic tool can be replicated off a metal master tool. The master tool will have the inverse pattern desired for the production tool. The master tool can be made in the same manner as the production tool. The master tool is preferably made out of metal, e.g., nickel and is diamond turned. The thermoplastic sheet material can be heated and optionally along with the master tool such that the thermoplastic material is embossed with the master tool pattern by pressing the two together. The thermoplastic can also be extruded or cast onto the master tool and then pressed. The thermoplastic material is cooled to solidify and produce the production tool. Examples of thermoplastic production tool materials include polyester, polycarbonates, polyvinyl chloride, polypropylene, polyethylene and combinations thereof. If a thermoplastic production tool is utilized, then care should typically be taken not to generate excessive heat that may distort the thermoplastic production tool.

The production tool may also contain a release coating to permit easier release of the abrasive article from the production tool. Examples of such release coatings for metals include hard carbide, nitrides or borides coatings. Examples of release coatings for thermoplastics include Silicones and fluorochemicals.

Additional details concerning methods of manufacturing structured abrasive articles having precisely-shaped abrasive composites may be found, for example, in U.S. Pat. No. 5,152,917 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,851,247 (Stoetzel et al.); and U.S. Pat. No. 6,139,594 (Kincaid et al.).

In another embodiment, a slurry comprising a binder precursor and abrasive particles may be deposited on a backing in a patterned manner (e.g., by screen or gravure printing) and partially polymerized to render at least the surface of the coated slurry plastic but non-flowing. Then, a pattern is embossed upon the partially polymerized slurry formulation, which is subsequently further cured (e.g., by exposure to an energy source) to form a plurality of shaped abrasive composites affixed to the backing. Further details concerning this method and related methods are described, for example, in U.S. Pat. No. 5,833,724 (Wei et al.); U.S. Pat. No. 5,863,306 (Wei et al.); U.S. Pat. No. 5,908,476 (Nishio et al.); U.S. Pat. No. 6,048,375 (Yang et al.); U.S. Pat. No. 6,293,980 (Wei et al.); and U.S. Pat. Appl. Publ. No. 2001/0041511 (Lack et al.).

In this embodiment, once the abrasive layer is affixed to the backing, the resultant structured abrasive articles, whether in sheet or disc form at this point, have shaped features embossed therein such that both the backing and the structured abrasive layer have superposed embossed features. Embossing may be accomplished by any suitable means including, for example, application of heat and/or pressure to an embossing die (i.e., by embossing) having the desired pattern (or its inverse) depending on the embossing conditions used. The embossing die may comprise, for example, a plate or a roll. Typically, the dimensions of the embossed features will be at least an order of magnitude larger in cross section (e.g., at least 10, 100 or even at least 1000 times larger) than the average size of the shaped abrasive composites.

Structured abrasive articles according to the present disclosure may be secured to a support structure such, for example, a backup pad secured to a tool such as, for example, a random orbital sander. The optional attachment interface layer may be, for example an adhesive (e.g., a pressure-sensitive adhesive) layer, a double-sided adhesive tape, a loop fabric for a hook and loop attachment (e.g., for use with a backup or support pad having a hooked structure affixed thereto), a hooked structure for a hook and loop attachment (e.g., for use with a back up or support pad having a looped fabric affixed thereto), or an intermeshing attachment interface layer (e.g., mushroom type interlocking fasteners designed to mesh with a like mushroom type interlocking fastener on a back up or support pad). Further details concerning such attachment interface layers may be found, for example, in U.S. Pat. No. 5,152,917 (Pieper et al.); U.S. Pat.

No. 5,254,194 (Ott); U.S. Pat. No. 5,454,844 (Hibbard et al.); and U.S. Pat. No. 5,681,217 (Hoopman et al.); and U.S. Pat. Appl. Publ. Nos. 2003/0143938 (Braunschweig et al.) and 2003/0022604 (Annen et al.).

Likewise, the second major surface of the backing may have a plurality of integrally formed hooks protruding therefrom, for example, as described in U.S. Pat. No. 5,672,186 (Chesley et al.). These hooks will then provide the engagement between the structured abrasive article and a back up pad that has a loop fabric affixed thereto.

Structured abrasive articles according to the present disclosure may be provided in any form (for example, as a sheet, belt, or disc), and be of any overall dimensions. Embossed structured abrasive discs may have any diameter, but typically have a diameter in a range of from 0.5 centimeter to 15.2 centimeters. The structured abrasive article may have slots or slits therein and may be otherwise provided with perforations.

Structured abrasive articles according to the present disclosure are generally useful for abrading a workpiece, and especially those workpieces having a hardened polymeric layer thereon. The workpiece may comprise any material and may have any form. Examples of materials include metal, metal alloys, exotic metal alloys, ceramics, painted surfaces, plastics, polymeric coatings, stone, polycrystalline silicon, wood, marble, and combinations thereof. Examples of workpieces include molded and/or shaped articles (e.g., optical lenses, automotive body panels, boat hulls, counters, and sinks), wafers, sheets, and blocks.

A lubricating fluid may be used in conjunction with the structured abrasive article during abrading operations. Examples include oils, water, and surfactant solutions in water (e.g., anionic or nonionic surfactant solutions in water).

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Materials

As used herein:

"TMPTA/TATHEIC BLEND" refers to a 70:30 wt./wt. blend of trimethylolpropane triacrylate and tris(hydroxyethoxyethyl) isocyanurate triacrylate, available as SARTOMER SR-368D, from Sartomer Co. of Exton, Pa.

"PI" is a photoinitiator, 2-benzyl-2(dimethylamino)-[4-(4-morpholinyl)phenyl]-1-butanone, obtained as IRGACURE 369 from Ciba Specialty Chemicals, Tarrytown, N.Y.

"A174" is a silane coupling agent 3-methacryloxypropyltrimethoxysilane, commercially available as SILQUEST A-174 SILANER from Momentive Performance Materials of Albany, N.Y.

"OX50" is amorphous silica, commercially available as AEROSIL OX 50 from Degussa Corp. of Vernon, Ill.

"FIL" is surface-treated calcium metasilicate, commercially available as M 400 WOLLASTOCOAT from NYCO of Willsboro, N.Y.

"P600" is FEPA grade P600 alumina particles, commercially available as FSX from Treibacher Schleifmittel, Niagara Falls, N.Y.

Example 1

A structured abrasive article was prepared by combining 778 parts of TMPTA/TATHEIC BLEND, 8 parts of PI, 8.2 parts of A174, 27.6 parts of OX50, 278 parts of FIL, and 1416 parts of P600 and mixing in a high-shear mixer. The resulting slurry was applied via knife coating at 50 feet per minute (15 meters/minute) to a 12-inch (30.5-cm) wide web of J-weight rayon backing that contained a dried latex/phenolic presize coating to seal the backing.

A 12-inch (30.5-cm) wide microreplicated polypropylene tooling was provided having recesses to provide an array of shaped abrasive composites (shaped generally as the shaped abrasive composite shown in FIG. 4) with a 60-mil (1.524 mm) pitch, each shaped abrasive composite was rotated 10 degrees from the machine direction. Each shaped cavity opening (corresponding to the base) was 50 mils×50 mils (1.27 mm×1.27 mm) and each wall rose at an 82 degree angle to a height of 30 mils (0.762 mm) above the base. The top face of each shaped abrasive composite had two orthogonal v-shaped cuts centrally disposed across the top face, each cut being 10 mils (0.254 mm) deep and furrowed at 128.7 degrees. The tooling was prepared from a corresponding master roll generally according to the procedure of U.S. Pat. No. 5,975,987 (Hoopman et al.).

The tooling was laid on the coated backing and passed through a nip roll (nip pressure of 60 pounds per square inch (psi) (413.7 kilopascals (kPa)) and irradiated with two 600 W/in (236 W/cm) ultraviolet (UV) lamps, type "D" bulbs, from Fusion Systems Inc. of Gaithersburg, Md. The polypropylene tooling was separated from the coated backing, resulting in a cured abrasive layer adhered to the backing. Abrasive belts for testing were prepared using conventional splicing techniques.

Comparative Example A

Comparative Example A was a commercial structured abrasive product of grade equivalent to Example 1 with triangular pyramidal microreplicated structures, obtained as 217EA A30 from 3M of St. Paul, Minn.

Comparative Example B

Comparative Example B was a commercial structured abrasive product of a grade equivalent to Example 1 with embossed surface features, obtained as NORAX U242-X30 from Saint-Gobain Abrasives Inc. of Worcester, Mass.

Test Procedure

Specimens were tested on a single belt robot grinder manufactured by Divine Brothers Co., Inc. of Utica, N.Y. Each specimen, as a 3 inches by 132 inches (7.6 cm×335.3 cm) belt, was mounted upon a 50 durometer 14-inch (36-cm) diameter smooth contact wheel which was driven at 1750 surface feet per minute (533 meters/minute) while a one inch by 10 inches (2.5 cm×25.4 cm) reciprocating (18 cm stroke, 40 strokes/minute) mild steel (1018) workpiece was positioned perpendicular to the axis of the contact wheel. The workpiece was forced against the belt using a constant load of 7 lbs (3.2 kg). Following each minute of grinding, the workpiece was weighed to determine the amount of material removed from the workpiece. Each incremental weight loss was reported as "cut". One-minute test cycles were continued until the incremental cut fell to a value of about ⅓ of the initial cut. The results are reported in Table 1 (below), wherein "-" means not measured.

TABLE 1

| TIME, minutes | CUT, grams COMPARATIVE EXAMPLE A | EXAMPLE 1 | COMPARATIVE EXAMPLE B |
|---|---|---|---|
| 1 | 2.7 | 2 | 3.7 |
| 6 | 3.2 | 2.8 | 4 |
| 12 | 3.4 | 2.8 | 3.2 |
| 18 | 3.3 | 3 | 2.9 |
| 24 | 3.5 | 2.9 | 2.9 |
| 30 | 3.1 | 3.1 | 2.7 |
| 36 | 2.9 | 3.2 | 2.3 |
| 42 | 2.6 | 3 | 1.6 |
| 48 | 1.6 | 2.8 | 1.1 |
| 54 | 1.1 | 2.9 | — |
| 60 | — | 3 | — |
| 66 | — | 3 | — |
| 72 | — | 3.1 | — |
| 78 | — | 3 | — |
| 84 | — | 2.9 | — |
| 90 | — | 3.1 | — |
| 96 | — | 2.7 | — |
| 102 | — | 3.1 | — |
| 108 | — | 2.8 | — |
| 114 | — | 2.9 | — |
| 120 | — | 3.1 | — |
| 126 | — | 2.7 | — |
| 132 | — | 2.7 | — |
| 138 | — | 2.9 | — |
| 144 | — | 2.6 | — |
| 150 | — | 2.8 | — |
| 156 | — | 2.8 | — |
| 162 | — | 2.7 | — |
| 168 | — | 2.7 | — |
| 174 | — | 2.7 | — |
| 180 | — | 2.7 | — |
| 186 | — | 2.7 | — |
| 192 | — | 2.7 | — |
| 198 | — | 2.7 | — |
| 204 | — | 2.2 | — |
| 210 | — | 2.2 | — |
| 216 | — | 1.8 | — |

All patents and publications referred to herein are hereby incorporated by reference in their entirety. All examples given herein are to be considered non-limiting unless otherwise indicated. Various modifications and alterations of this disclosure may be made by those skilled in the art without departing from the scope and spirit of this disclosure, and it should be understood that this disclosure is not to be unduly limited to the illustrative embodiments set forth herein.

What is claimed is:

1. A structured abrasive article comprising:

a backing having first and second opposed major surfaces; and an abrasive layer disposed on and secured to the first major surface, wherein the abrasive layer comprises shaped abrasive composites, wherein each of the shaped abrasive composites comprises abrasive particles dispersed in a polymeric binder, and wherein each of the shaped abrasive composites independently comprises:

a base disposed on the backing;

a plurality of planar walls extending away from the base, wherein adjacent planar walls share a common edge, wherein each planar wall forms a first dihedral angle with the base of less than or equal to 90 degrees; and a grinding surface not in contact with the base, wherein the grinding surface has:

a plurality of cusps; and a plurality planar facets that contact a recessed feature capable of being contained within a geometric plane, wherein at least a portion of the recessed feature is disposed closer to the base than each of the cusps, and wherein each cusp is a sharp point formed by an intersection of two of the planar walls and at least one of the planar facets.

2. The structured abrasive article of claim 1, wherein each of the planar walls is perpendicular to the base.

3. The structured abrasive article of claim 1, wherein the first dihedral angle is in a range of from 80 to 85 degrees.

4. The structured abrasive article of claim 1, wherein each of the cusps is substantially equidistant from the base.

5. The structured abrasive article of claim 1, wherein the recessed feature is a polygon.

6. The structured abrasive article of claim 1, wherein the recessed feature is a line.

7. The structured abrasive article of claim 1, wherein the recessed feature is sloped relative to the base.

8. The structured abrasive article of claim 2, wherein the recessed feature is a point.

9. The structured abrasive article of claim 1, wherein, relative to its base, each of the shaped abrasive composites has a height, and wherein the recessed feature has a lowest point that is higher than half of the height.

10. The structured abrasive article of claim 1, wherein each of the shaped abrasive composites independently has 3, 4, or 6 planar walls.

11. The structured abrasive article of claim 1, wherein the shaped abrasive composite has 4 planar walls.

12. The structured abrasive article of claim 11, wherein the base is substantially square.

13. The structured abrasive article of claim 1, wherein the shaped abrasive composites do not contact one another.

14. The structured abrasive article of claim 1, wherein the shaped abrasive composites are separated by a plurality of linear channels extending across the first surface of the backing.

15. The structured abrasive article of claim 1, wherein the shaped abrasive composites collectively comprise a close-packed array.

16. The structured abrasive article of claim 1, wherein at least some of the planar facets contacting adjacent cusps independently define a second dihedral angle in a range of from 120 to 135 degrees.

17. The structured abrasive article of claim 1, wherein each of the shaped abrasive composites has substantially the same size and shape.

18. The structured abrasive article of claim 1, further comprising a supersize disposed on the abrasive layer.

19. The structured abrasive article of claim 1, further comprising an attachment interface layer disposed on the second major surface.

20. The structured abrasive article of claim 1, wherein the structured abrasive article has a load-bearing area in a range of from 50 to 70 percent.

21. The structured abrasive article of claim 1, wherein:

the shaped abrasive composites have a base with sides in a range of from 30 to 60 mils and a maximum height in a range of from 15 to 30 mils;

the planar facets contacting adjacent cusps independently define a dihedral angle in a range of from 120 to 135 degrees;

the planar walls independently form a respective dihedral angle with the base in a range of from 78 to 90 degrees;

the shaped abrasive composites are separated by a plurality of linear channels extending across the first surface of the backing, wherein the channels have a width in a range of from 10 to 30 mils; and relative to its base, each of the shaped abrasive composites has a height, and wherein the recessed feature has a lowest point that has a height in a range of from 40 to 80 percent of the height of the shaped abrasive composite.

22. A method of abrading a workpiece, the method comprising:

frictionally contacting at least a portion of the abrasive layer of the structured abrasive article of claim 21 with a surface of the workpiece; and moving at least one of the workpiece or the abrasive layer relative to the other to abrade at least a portion of the surface of the workpiece.

23. A method of abrading a workpiece, the method comprising:

frictionally contacting at least a portion of the abrasive layer of the structured abrasive article of claim 1 with a surface of the workpiece; and moving at least one of the workpiece or the abrasive layer relative to the other to abrade at least a portion of the surface of the workpiece.

* * * * *

UNITED STATES PATENT AND TRADEMARK OFFICE

CERTIFICATE OF CORRECTION

PATENT NO. : 8,425,278 B2
APPLICATION NO. : 12/547590
DATED : April 23, 2013
INVENTOR(S) : Scott R Culler It is certified that error appears in the above-identified patent and that said Letters Patent is hereby corrected as shown below:

In the Specifications:

Column 5
Line 1, Delete "613," and insert -- 6B, --, therefor.

Column 10
Line 8, Delete "precursor;" and insert -- precursor, --, therefor.

Column 11
Lines 8-9, Delete "plasticizers:" and insert -- plasticizers; --, therefor.

Column 12
Line 13, Delete "Silicones" and insert -- silicones --, therefor.

Signed and Sealed this
Sixth Day of August, 2013

Teresa Stanek Rea
*Acting Director of the United States Patent and Trademark Office*